United States Patent [19]

Prochnow et al.

[11] 4,002,121

[45] Jan. 11, 1977

[54] INCENDIARY PAYLOAD FOR A HEAVY-DUTY BALLISTIC PROJECTILE

[75] Inventors: Jüergen Prochnow; Alfred Johannes, both of Duesseldorf, Germany

[73] Assignee: Rheinmetall GmbH., Duesseldorf, Germany

[22] Filed: Aug. 1, 1975

[21] Appl. No.: 600,965

[30] Foreign Application Priority Data

Aug. 3, 1974 Germany ..... 2437535

[52] U.S. Cl. ..... 102/66; 102/90

[51] Int. Cl.[2] ..... F42B 13/14

[58] Field of Search ..... 102/6, 65, 66, 90

[56] References Cited

UNITED STATES PATENTS

| | | | |
|---|---|---|---|
| 1,279,422 | 9/1918 | Peterson | 102/6 |
| 3,713,383 | 1/1973 | Crescenzo et al. | 102/6 |

FOREIGN PATENTS OR APPLICATIONS

| | | | |
|---|---|---|---|
| 411,540 | 8/1945 | Italy | 102/66 |
| 259,539 | 7/1926 | United Kingdom | 102/6 |

*Primary Examiner*—Verlin R. Pendegrass

[57] ABSTRACT

A ballistic missile is provided with an incendiary-type payload in which the incendiary composition is distributed around the ignition channel of the projectile within a plurality of successively disposed annular containers formed from a light metal alloy. Upon detonation, the individual containers forming the payload are successively ejected from the tail of the projectile in a ring-like pattern, and remain intact upon impact with the targeted terrain whereby the desired incendiary effect continues for a prolonged predetermined time.

6 Claims, 2 Drawing Figures

INCENDIARY PAYLOAD FOR A HEAVY-DUTY BALLISTIC PROJECTILE

BACKGROUND OF THE INVENTION

The invention relates to an incindiary-type payload for a heavy-duty ballistic projectile, such payload being of the type wherein the incendiary composition surrounds the central ignition channel of the projectile and is disposed longitudinally therealong between the nose and tail portions of the projectile.

In presently known arrangements of this type, the incendiary composition is distributed in the form of briquettes around the boundary of the ignition channel. In such arrangements, when an explosive charge disposed at the tail end of the projectile is detonated, the resulting generation of hot gases ignite the briquettes and the latter are propelled forwardly to tear away the nose area of the projectile, whereby the briquettes are scattered in ring-like fashion over the terrain to be covered.

One disadvantage of such arrangements is that since the scattered briquettes are fully exposed to the air, they burn out very quickly. In addition, in heavy-duty projectiles wherein the force and velocity of expulsion of the burning briquettes is very large, such briquettes tend to crumble and disintegrate either during their flight from the projectile or upon impact with the terrain.

SUMMARY OF THE INVENTION

These disadvantages are overcome with the ejectable-type incendiary payload of the present invention, which like prior art arrangements if formed from incendiary material distributed around the central ignition channel of the projectile between the nose and tail portions thereof. Unlike such prior art arrangements, however, the payload of the instant invention contemplates that such incendiary material is encased and distributed in a plurality of mold-like hollow annular elongated containers which are successively disposed between the nose and tail sections of the projectile. Each container is simply and inexpensively constructed; it is bounded radially by inner and outer cylindrical jackets formed from a high-strength light metal alloy, and is bounded longitudinally by a pair of annular end plates of similar material.

Preferably, the boundary jackets and plates are loosely abutted against each other to confine the associated incendiary material, and a rigid assembly is obtained by reinforcing the outer jacket with a surrounding light metal sleeve which has inwardly extending flange portions which compressively engage mating recesses in the opposed end plates. In like manner, the inner jacket of each container is reinforced by a sleeve that has outwardly-directed flange portions on each end, such flange portions compressively engaging mating recesses in the opposed end plates coplanar with the flange portions of the outer sleeve. The inner jacket and associated sleeve of each container define the outer boundary of the associated portion of the ignition channel, and are provided with apertures extending radially therethrough to permit communication between the interior of the ignition channel and the incendiary material in the interior of the container, whereby such incendiary material can be ignited by hot gases passing through the ignition channel during detonation.

Such arrangements of self-contained container for supporting the incendiary material around the ignition channel collectively form a self-supporting column which can withstand the tremendous force and velocity of ejection from heavy-duty projectiles. Moreover, since each of the successively ejected containers remains intact upon impact with the targeted terrain, the so-confined incendiary material likewise remains intact and is permitted to burn slowly and regularly for a predetermined time, rather than burning up in an uncontrolled fashion as in the prior art.

BRIEF DESCRIPTION OF THE DRAWING

The invention is further set forth in the following detailed description taken in conjunction with the appended drawing, in which.

DETAILED DESCRIPTION

Figure 1:
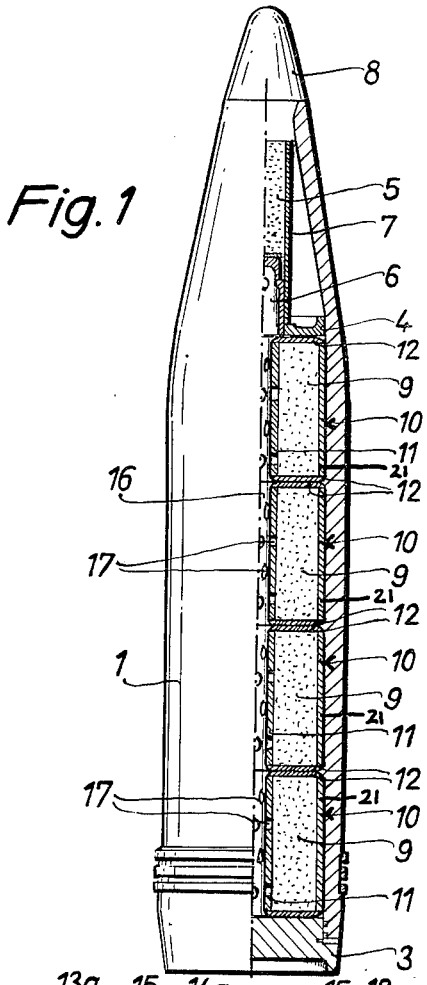
FIG. 1 is a longitudinal view, partially in section, of a heavy-duty projectile containing an incendiary-type ejectable payload in accordance with the invention.

Referring now to the drawing, the numeral 1 depicts a conventional heavy-duty projectile having a nose portion 8 containing a conventional time fuse and a removable tail portion or floor 3. An explosive charge 5 is disposed near the nose 8, and is contained within a shell 7 which is adapted to disintegrate when the charge 5 is detonated by the fuse in the nose 8.

The projectile 1 is provided with an ejectable-type payload which has as its working element a suitable incendiary composition represented at 9. (It will be understood that the term "incendiary" is used in a generic sense to denote materials which, when ignited, either burst into flames or yield heavy smoke.) The incendiary composition 9 is disposed in the projectile 1 between a piston 4, which surrounds a hollow spacer 6 in contact with the explosive charge 5 in the nose of the projectile 5, and the removable floor 3. Also, such composition 9 is arranged to surround a central elongated ignition channel 16 of the projectile 1 in annular fashion. The channel 16 extends between the spacer 6 and the removable floor 3 of the projectile.

In accordance with the invention, the incendiary composition 9 is confined within a plurality of successively disposed containers 10, 10 which are formed from separable elements of a high-strength light metal alloy. The containers 10 are compressively arranged in abutting relation between the piston 4 and the removable floor 3 as shown, thereby collectively defining a stable, self-supporting column capable of withstanding the high shockloads and velocity upon their ejection from the projectile 1 as indicated below.

In particular, each of the containers 10 is bounded radially by an inner cylindrical jacket 11 and an outer cylindrical jacket 21. The jackets 11 and 21 are interconnected at both longitudinal ends of the container by a pair of annular end plates 12, 12 formed from a similar high-strength light metal alloy.

In order to rigidly hold the jackets 11 and 21 and the end plates 12, 12 of each container together, each of the end plates 12 are provided with recesses 15, 15 on the radially inner and outer portions thereof. The recess 15 associated with the radially outer portion of the end plates 12 is adapted to receive inwardly bending flange portions 13*a*, 13*a* of a reinforcing sleeve 13 which surrounds the outer jacket 21 in intimate contact therewith. Similarly, the recesses 15 on the radially inner portions of the end plates 12 are adapted to receive outwardly bending flange portions 14*a*, 14*a* of a second reinforcing sleeve 14 that is disposed in intimate contact with the inner cylindrical wall 11 of the container 10. The flange portions 13*a*, 14*a* are adapted to apply compressive forces on the engaged end plates 12, thereby providing the required rigidity of the container 10 in a simple and inexpensive fashion. The sleeves 13 and 14 may be of thinner wall thickness than, and formed from the same high-strength light metallic alloy as, the associated inner and outer cylindrical jackets 11 and 21.

Figure 2:
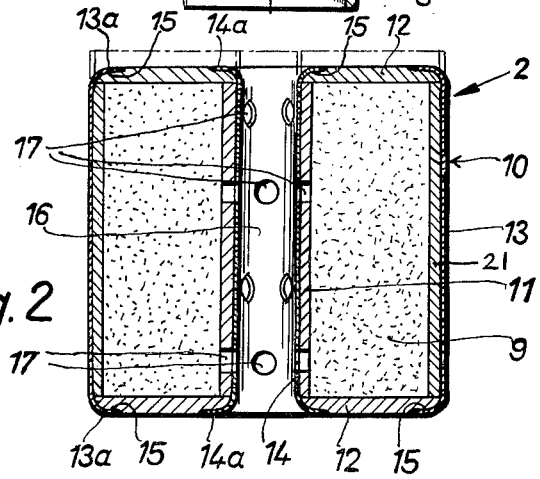
FIG. 2 is a longitudinal section through one of a plurality of successively disposed metallic containers constructed in accordance with the invention for containing the incendiary composition in the arrangement of FIG. 1.

Because of the presence of the recesses 15, the outer surfaces of the flange portions 13*a* and 14*a* can terminate flush with the external surfaces of the engaged end plates 12, as shown. The inner reinforcing sleeve 14 advantageously defines the outer radial boundary of the adjacent portion of the central ignition chamber 16 of the projectile 1. Such sleeve 14, together with the adjacent inner cylindrical jacket 11, are provided with a plurality of apertures 17, 17 extending radially therethrough for providing communication between the interior of the chamber 16 and the charge 9 within the container 10. The apertures 17 are distributed both circumferentially and longitudinally in the container 10 as shown in FIG. 2. The arrangement illustrated in FIGS. 1 and 2 operates as follows:

When the time fuse (not shown) in the nose portion 8 of the projectile 1 has burned for a predetermined time, the explosive charge 5 is detonated and the shell 7 disintegrates. A first portion of the combustion gases generated upon the ignition of the charge 5, after liberation from the shell 7, pushes rearwardly against the piston 4 with sufficient force that the self-supporting column defined by the four successive containers 10 in turn pushes rearwardly against the removable floor 3, so that the latter is pushed out of the projectile 1. Therefore, the successive containers 10 are conditioned for high speed discharge from the tail of the projectile 1.

A second portion of the hot combustion gases generated by the ignited charge 5 passes through the hollow material of the spacer 6 and enters the ignition channel 16, which as noted above is bounded by the successive inner reinforcing shells 14 of the containers 10. Such hot gases passing along the channel 16 ignite the incendiary composition 9 in the interior of the containers 10 via the apertures 17.

The containers 10 containing the now-ignited composition 9, upon successive ejection from the tail of the projectile 1, are scattered in a ring-like area of the targeted terrain. Upon impact, the containers 10 remain intact, thereby permitting the composition 9 to likewise remain intact and to burn at a controlled rate for a predetermined time. In this regard, the apertures 17 permit sufficient oxygen from the air to enter the interior of the containers 10 to support the combustion, but not to enter in such quantities as to prematurely burn out the composition as in the prior art.

In the foregoing, an illustrative arrangement of the invention has been described. Many variations and modifications will now occur to those skilled in the art. It is accordingly desired that the scope of the appended claims not be limited to the specific disclosure herein contained.

What is claimed is:

1. In an elongated, heavy-duty ballistic projectile wherein a detonation-charge containing nose portion of the projectile communicates axially with a tail section thereof through a central ignition channel, and wherein an ejectable payload comprising incendiary material is disposed along and arranged coaxially around the central ignition channel and is disposed before detonation within a plurality of hollow annular elongated containers, the containers being successively disposed in abutting relation between the nose portion of the projectile and an end plate situated in the tail of the projectile behind the rear-most container, the inner boundary of each container including at least one aperture extending radially therethrough for providing communication between the interior of the ignition channel and the incendiary material within the associated container to effect ignition of the incendiary material upon detonation of the charge, the improvement wherein the end plate in the tail section is removably supported within the tail section and is adapted to be blown free of the projectile by gas pressure generated during detonation of the charge and conducted to the end plate through the ignition channel; and wherein the containers are each formed from a material capable of withstanding the gas pressure generated during detonation of the charge so that the containers remain intact as a self-supporting column after the incendiary material therein is ignited, whereby the intact containers with the ignited incendiary charge disposed therein are ejected rearwardly in a sequential manner out of the projectile when the end plate is blown clear of the projectile.

2. The improvement as defined in claim 1, in which the incendiary material is in the form of a briquette, in which each container is bounded radially by inner and outer cylindrical jackets and bounded longitudinally by a pair of annular end plates, in which the outer jacket of each container is outwardly reinforced with a first shell having oppositely disposed, inwardly-bending flange portions for compressively engaging the adjacent external surfaces of both associated end plates, and in which the inner jacket of each container is inwardly reinforced with a second shell having oppositely disposed, outwardly-bending flange portions for compressively engaging the adjacent external surfaces of both associated end plates.

3. The improvement as defined in claim 2, in which the second sleeves of the successive containers form the radially outer boundary of the central ignition channel.

4. The improvement as defined in claim 2, in which the end plates of each container are recessed in their areas of contact with the flange portions of the associated sleeves so that the external surfaces of such flange portions terminate flush with the external surfaces of the end plates.

5. The improvement as defined in claim 2, in which each second sleeve and the associated inner jacket of each container include apertures extending radially therethrough for providing communication between the interior of the ignition channel and the incindiary material within the associated container.

6. The improvement as defined in claim 2, in which the jackets, end plates and sleeves associated with each container are formed from a high-strength alloy of a light metal.

* * * * *